United States Patent [19]

Pritchard

[11] Patent Number: 4,958,255

[45] Date of Patent: Sep. 18, 1990

[54] ELECTROSTATIC DISCHARGE AND ELECTROMAGNETIC INTERFERENCE PROTECTION CIRCUIT

[75] Inventor: Thomas B. Pritchard, Vancouver, Wash.

[73] Assignee: Hewlett-Packard Company, Palo Alto, Calif.

[21] Appl. No.: 291,489

[22] Filed: Dec. 28, 1988

[51] Int. Cl.[5] ..... H05F 3/00

[52] U.S. Cl. ..... 361/212

[58] Field of Search ..... 361/117, 133, 136, 212, 361/214, 220, 233

[56] References Cited

U.S. PATENT DOCUMENTS 4,523,252 6/1985 Wallén ..... 361/212

4,715,086 12/1987 Johanson et al. ..... 361/220

4,720,048 1/1988 Maroney et al. ..... 361/217

*Primary Examiner*—A. D. Pellinen

*Assistant Examiner*—Jeffrey A. Gaffin

[57] ABSTRACT

The protection circuit of the invention connects differentiated grounds in an electronic system either by a single diode, or by two diodes arranged in a back-to-back, parallel fashion. The differentiated grounds may include a chassis ground, a logic ground and an earth ground. The circuit locally connects two of the differentiated grounds, thereby providing a low inductance path for the fast discharging of electrostatic charge build-ups, with the diode(s) therein providing the electrical separation necessary to provide proper local isolation between the interconnected grounds to enable filtering out of electromagnetic interference potentials.

14 Claims, 1 Drawing Sheet

ELECTROSTATIC DISCHARGE AND ELECTROMAGNETIC INTERFERENCE PROTECTION CIRCUIT

TECHNICAL FIELD

This invention relates to circuitry used to protect electronic components from electrostatic discharge and electromagnetic interference, and more particularly, to specific circuits used to protect against such problems.

BACKGROUND ART

Electronic devices or systems such as computers and printers may contain various grounds. A ground is a conducting connection used to establish and maintain the electrical potential of the earth or other grounding body on conductors connected to it.

For example, a computer printer may be grounded to the earth by a ground lead contained in a 3-wire power cord connecting the printer to an electrical outlet. Additionally, a computer printer may include a chassis ground wherein the printer's chassis is the grounding body.

An electronic device may also contain a logic or circuit ground which provides a reference ground potential to components such as digital logic circuitry. A logic ground generally uses the earth ground as the grounding body. However, the conductive path from the logic ground to the point of connection with the earth ground is often lengthy, resulting in a high inductance. Such high inductance, with current flow, creates an electromotive force in the circuitry which affects the ability of the conductive path to maintain a certain ground potential or to discharge certain charges to the earth.

Electronic devices such as computers and printers are often also exposed to electrostatic discharge. Electrostatic discharge is a dissipation of an electric charge often causing spurious sharp voltage pulses that can damage or interfere with the operation of electronic equipment. Such charges may originate from varied sources such as a user touching a keyboard or paper being fed into a printer.

To prevent the possibility of damage from electrostatic discharge, electronic devices may be shielded. Shielding may consist of an electroplate coating on the surrounding enclosure. However, such shielding is expensive and difficult to employ.

Alternatively, a separate conductive path with a low inductance to earth ground may be used. Such a path may be supplied by using electronic components such as a four-layer printed circuit board. In such a case, one or more layers of the board may be dedicated to provide a ground plane. However, additional board layers are also relatively expensive. In addition, it is desirable to steer the electrostatic discharge current away from the electronic components. Accordingly, a more desirable low inductance path would be through the chassis, which is connected to earth ground. Such a path is referred to as chassis ground.

When digital logic or other electronics performs under normal operation, it draws time-varying current through logic ground. When there is inductance between logic ground and earth ground, the logic ground becomes contaminated. Contamination refers to unnecessary high frequency signals superimposed on the desirable signal.

Additionally, electronic devices often create, and are affected by, electromagnetic interference. Such interference is undesirable contamination of a signal which tends to obscure the information content of the signal. To minimize electromagnetic interference, it is desirable to filter out the contamination. A clean ground must be used to filter out the contamination; if the contaminated ground were directly connected to the clean ground, the clean ground would become contaminated, and the filter would not function. So the contaminated ground, such as logic ground, must remain isolated from the clean ground, such as the chassis ground.

This invention overcomes the limitations of the prior art by providing an inexpensive protection circuit which conducts electrostatic discharge by way of a low inductance path to a ground capable of dissipating such signals, while isolating the "contaminated" ground, such as the logic ground, from a "clean" ground in the system, such as the chassis ground.

DISCLOSURE OF THE INVENTION

The protection circuit of the invention takes the form of a conductive circuit connected between differentiated grounds in an electronic device. The conductive circuit includes either a single diode, or two diodes arranged in a back-to-back parallel fashion. The differentiated grounds may include a chassis ground, a logic ground and an earth ground. The conductive circuit locally connects two of the differentiated grounds, thereby providing a low inductance fast path for discharging electrostatic charge build-ups, with the diode(s) in the circuit providing the preconduction threshold potential isolation necessary to provide proper local isolation between the grounds to enable filtering out of electromagnetic interference potentials.

DETAILED DESCRIPTION AND BEST MODE FOR CARRYING OUT THE INVENTION

Figure 1:
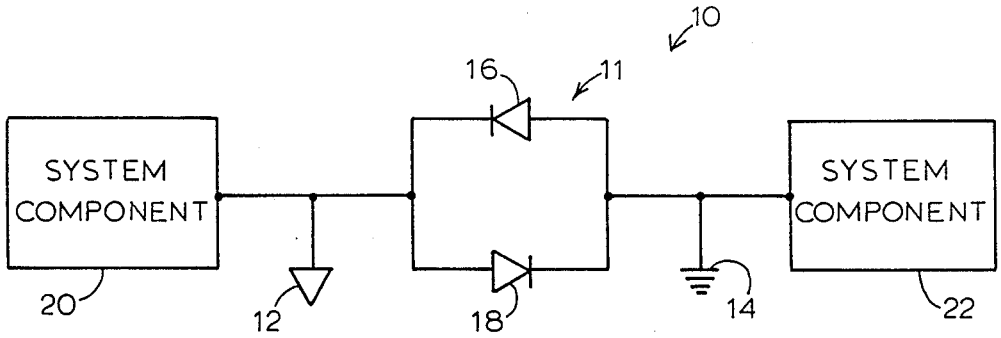
FIG. 1 is a block/schematic diagram illustrating a dual-diode protection circuit constructed in accordance with the invention connected between a logic ground and a chassis ground in an electrical device.

FIG. 1 shows generally at 10 an electronic system employing a protection circuit 11 constructed in accordance with the invention. System 10 includes a logic ground 12 and a chassis ground 14. Often a ground, such as logic ground 12, has a high inductance path to earth ground. Accordingly, such a ground is unable to dissipate electrostatic discharge or electromagnetic interference potentials effectively.

Circuit 11 provides a low inductance, fast path to ground by locally directly connecting logic ground 12 to chassis ground 14 by diodes 16, 18. Diodes 16, 18 provide a conductive path whereby an electrostatic charge build-up, or an electromagnetic interference potential, at ground 12 may be dissipated rapidly to chassis ground 14. Diodes 16, 18 are arranged in a back-to-back, parallel configuration to accommodate both positive and negative potentials at ground 12.

Figure 2:
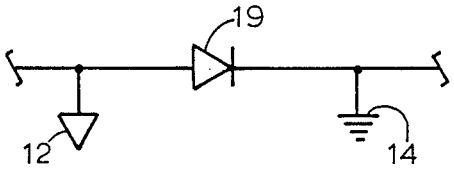
FIG. 2 illustrates a modified form of the protection circuit of FIG. 1, in the same kind of setting, with the modified circuit employing a single diode.

A single diode may be used where a device would only be subject to either positive or negative charges. For example, FIG. 2 illustrates such a modified form of protection circuit employing a single diode 19 which is capable of handling expected positive potential rises of logic ground 12 relative to chassis ground 14. Were a reverse situation expected, with unwanted negative potentials anticipated on logic ground 12 relative to ground 14, a single diode, such as diode 19, would be used connected in the reverse direction.

System 10 further includes a first system component 20 connected to logic ground 12. Ground 12 provides component 20 a reference ground potential. A second system component 22 is grounded to chassis ground 14. Ground 14 provides component 22 a separate ground potential.

Generally, in an electronic device, an internal ground, such as logic ground 12, would not be directly connected to a chassis ground, in order to minimize contamination of the chassis ground. Again, contamination refers to high frequency signals superimposed on the desired signal. Chassis ground 14 is desirably required to be a "clean ground", in order to minimize what is known as common mode electromagnetic interference. In the preferred embodiment, diodes 16, 18 provide the preconduction threshold potential isolation necessary to minimize contamination problems.

When an electrostatic discharge occurs at ground 12, with this discharge characterized by a potential which rises above (in an absolute sense) the threshold voltage of the back-to-back diodes, charge is conducted to chassis ground 14 across diode 16 or 18, depending upon its polarity. Under circumstances where no relative potential changes occur between the grounds, which changes exceed the threshold potential of the diodes, these diodes, in effect, isolate grounds 12, 14 in a bidirectional manner. Put another way, diodes 16, 18 set a bidirectional preconduction isolating threshold potential.

Figure 3:
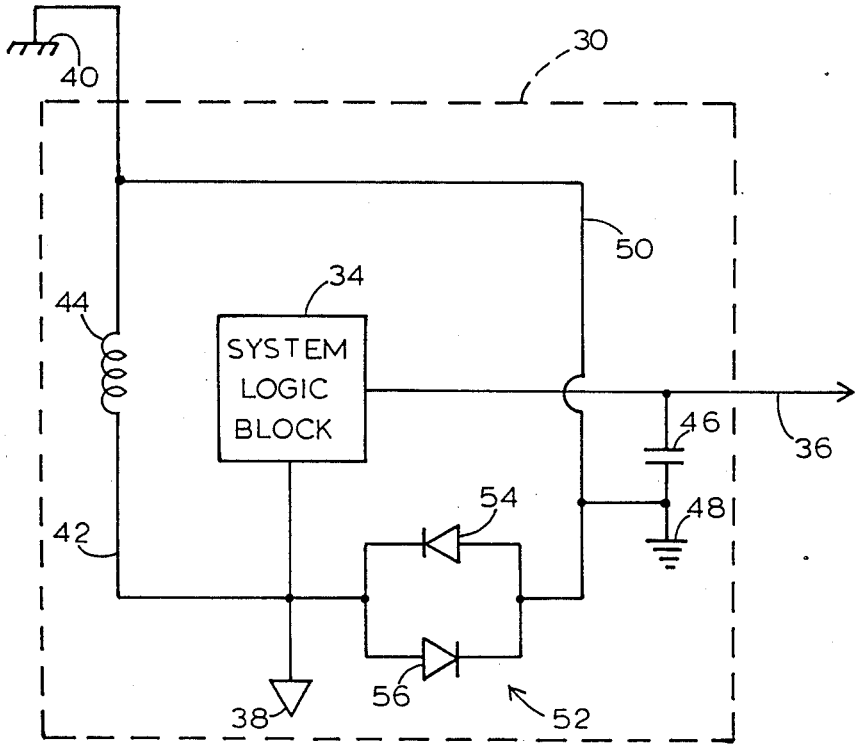
FIG. 3 illustrates a dual-diode protection circuit constructed in accordance with the invention employed in an electronic device having a logic ground and a chassis ground each connected to an earth ground.

FIG. 3 shows generally at 30, within dashed lines, another electronic system employing the protection circuit of the invention. System 30 includes a system logic block 34 which uses a signal on a conductor 36. Block 34 is grounded to a logic ground 38. Ground 38 is connected to earth ground 40 by way of conductive path 42, which is typically a relatively narrow, and therefore a relatively high inductance, route to the earth ground. Such inductance is represented in FIG. 3 by an inductor 44.

System 30 also includes a capacitor 46 which connects conductor 36 to a chassis ground 48. Capacitor 46 and chassis ground 48 filter certain electromagnetic interference potentials from the signal on conductor 36. Chassis ground 48 is also connected to earth ground 40 by a conductive path 50.

Logic block 34 may produce an electromagnetic interference potential build-up at logic ground 38 or, alternatively, an electrostatic discharge may arise at logic ground 38. Ground 38 may be unable to dissipate any such charges or interference potentials to earth ground 40 by means of path 42 because of the high inductance symbolized by inductor 44. Accordingly, system 30 includes protection circuit 52 to provide a path whereby such electromagnetic interference potentials and electrostatic charges may be dissipated. Circuit 52, which includes back-to-back, parallel diodes 54, 56, connects logic ground 38 to chassis ground 48 and to earth ground 40 as shown.

With the protection circuit of the invention, electrostatic discharge, and electromagnetic interference signals, in a system including components and elements sensitive to such aberrations are handled, and substantially eliminated, in a relatively low-cost manner. In particular, such interference conditions are eliminated through the approach of diode-connecting potentially offending nodes, typically ground nodes, in a system.

INDUSTRIAL APPLICABILITY

The protection circuit of the invention is illustrated herein in a setting wherein it will most often be useful, namely, in the setting of dealing with relative potential changes between differentiated grounds. However, one should also recognize that the protection circuit of the invention may be used in any instance where it is desired to minimize similar problems occurring between any two nodes that nominally bear signals of matching potential, whether that potential is expected to be non-time varying or time varying.

Accordingly, while a preferred embodiment, and a modification, of the invention have been described herein, other variations and changes may be made without departing from the spirit of the invention.

What is claimed is:

1. In an electronic system:

a first ground;

a second ground; and a conductive protection circuit including discharge means connected between said two grounds for conducting electrostatic discharge between said two grounds while providing isolation of electromagnetic interference potentials.

2. The circuit of claim 1, wherein one of said grounds is a logic ground and the other is a chassis ground.

3. The circuit of claim 1, wherein said discharge means comprises two diodes connected in a back-to-back, parallel fashion.

4. The circuit of claim 1, wherein said discharge means comprises a single diode.

5. The circuit of claim 1, wherein said discharge means is characterized bidirectionally by a preconduction threshold potential.

6. The circuit of claim 5, wherein one of said grounds is a logic ground and the other is a chassis ground.

7. The circuit of claim 5, wherein said discharge means comprises two diodes connected in a back-to-back, parallel fashion.

8. In an electronic system:

a first node nominally bearing a predetermined electrical potential;

a second node also nominally bearing such predetermined electrical potential; and a conductive protection circuit including discharge means connected between said nodes for conducting electrostatic discharge between said two nodes while providing isolation of electromagnetic interference between said nodes.

9. The circuit of claim 8, wherein said discharge means comprises two diodes connected in a back-to-back, parallel fashion.

10. The circuit of claim 8, wherein said discharge means comprises a single diode.

11. The circuit of claim 8, wherein said discharge means is characterized bidirectionally by a preconduction threshold potential.

12. The circuit of claim 11, wherein said discharge means comprises two diodes connected in a back-to-back, parallel fashion.

13. In an electronic system:

an output signal conductor;

system logic block means for producing a signal on said conductor;

a first ground conductively connected to said system logic block means;

a filter conductively connected to said conductor, including a second ground; and back-to-back diodes conductively connected in a parallel fashion between said first and second grounds.

14. The circuit of 13, wherein said first ground is a logic ground and said second ground is a chassis ground.

* * * * *